United States Patent [19]

Stungis et al.

[11] 4,009,723

[45] Mar. 1, 1977

[54] METHOD FOR CUTTING A TOBACCO PRODUCT ROD AND INCREASING THE END STRENGTH THEREOF

[75] Inventors: George E. Stungis; Steven L. Merker, both of Louisville, Ky.

[73] Assignee: Brown & Williamson Tobacco Corporation, Louisville, Ky.

[22] Filed: Jan. 13, 1975

[21] Appl. No.: 540,634

[52] U.S. Cl. ..... 131/84 R; 131/21 D

[51] Int. Cl.[2] ..... A24C 5/28

[58] Field of Search ..... 131/20, 23, 63, 10 R, 131/65, 248, 84 C, 144, 17 R; 219/121 L, 121 LM

[56] References Cited

UNITED STATES PATENTS

| | | | |
|---|---|---|---|
| 78,117 | 5/1868 | Morrison | 131/144 |
| 239,661 | 4/1881 | Kimball | 131/144 |
| 3,040,752 | 6/1962 | Ganz | 131/10 R UX |
| 3,475,760 | 10/1969 | Carlson | 219/121 LM |
| 3,490,462 | 1/1970 | Martin | 131/17 R |
| 3,534,462 | 10/1970 | Cruickshank et al. | 219/121 LM |

FOREIGN PATENTS OR APPLICATIONS

| | | | |
|---|---|---|---|
| 1,333,867 | 10/1973 | United Kingdom | 131/63 |

*Primary Examiner*—Robert W. Michell
*Assistant Examiner*—V. Millin
*Attorney, Agent, or Firm*—William J. Mason

[57] ABSTRACT

A tobacco rod is cut with a laser beam using specified time constraints and power levels under essentially atmospheric conditions without utilizing coolant means to prevent charring of the cigarette paper. Additionally, end integrity of cut rods can be increased by treating the tobacco shreds with a material having the characteristic of forming a non-toxic substance capable of bonding the shreds together in the presence of a heat source. Cutting the rod of treated tobacco shreds with a laser beam of specified time constraints and power levels permits the bonding of the shreds in the narrow region bordering the cut, thereby providing the desired increased end strength.

10 Claims, 4 Drawing Figures

METHOD FOR CUTTING A TOBACCO PRODUCT ROD AND INCREASING THE END STRENGTH THEREOF

FIELD OF THE INVENTION

This invention relates to a process for cutting tobacco rods and, more particularly, to a process for cutting tobacco rods with a laser.

BACKGROUND OF THE INVENTION

Conventional continuous cigarette rod making machines generally include a feeder and a making apparatus. The feeder showers tobacco material on a rapidly moving paper web which is guided through a rod folder tongue and a paster which seals the paper about the tobacco and forms a continuous rod. The rod then passes through a cut-off wherein a rotating knife blade is driven in a predetermined time relative to the movement of the rod. The cut rods are picked up and delivered to other units for further processing.

There are a number of commercially available, high-speed cigarette makers on the market. Many are capable of making up to about 4,000–5,000 cigarettes a minute. Above this speed, however, it becomes increasingly difficult to provide machinery with moving parts capable of sustained operation. Particularly susceptible to wear are the rotating or reciprocating parts which contact the rod, such as the cutter employed to sever the rod into individual lengths. The high rotational speed required to keep pace with the moving rod is extremely difficult to attain or control. Errors in the precise cutting of the rod rapidly become large as rotational speeds are increased. Additionally, the edge of the rotating blade is quickly eroded and requires constant sharpening.

Cigarettes are generally filled with short shreds of tobacco material. The mass of shreds within the rod is slightly compressed and retains its integrity in part due to entanglement and random orientation of the shreds. At the ends of the rod, integrity is less, thus giving rise to a greater probability of having loose ends. The decreased integrity may result in shreds being lost during further processing or in the fall out of the burning cone during consumer use. High speed cutting of the rod appears to aggravate the problem of loose ends, since many shreds are torn or pulled away from the mass. The ends of the cigarettes are in many instances visually "out-of-the-round" and less dense than other portions of the tobacco column. Not only is the appearance of the tobacco product unappealing to the consumer, but often the delivery of the taste constituents in the smoke is undesirably altered.

Industrial application of the laser is becoming increasingly commonplace. Operations, such as fine welding, cutting, and drilling, have been particularly amenable to the use of the laser, which, in at least one instance, has been used in the manufacture of tobacco products. The laser is particularly useful in the cutting and removal of materials in selected regions because of its ability to generate an intense coherent beam of light, thereby permitting transmission of large amounts of energy in a narrow, substantially nondivergent beam.

The use of a laser, however, has a disadvantage when the laser is being employed with materials which are chemically or physically affected when in the proximity of high temperatures or other materials which suffer deformations due to overheating. Combustible materials, for example, may ignite or char when exposed to a laser beam. As described in U.S. Pat. No. 3,679,863, a laser is employed to cut a combustible workpiece, such as timber, carpet, fabric, and, particularly, paper, which ordinarily results in the charring or deposition of distillates. To prevent combustion, a jet of inert gas carrying an atomized stream of liquid coolant is directed on to the moving region of the workpiece at which the laser beam is concentrated. U.S. Pat. No. 3,629,546 also describes the use of a coolant air stream for similar purposes.

United Kingdom Pat. No. 1,333,867 sets forth a method for cutting a cigarette rod via a deflected laser beam. A laser device produces a beam which is deflected by a mirror system so as to be reciprocated both in line with the rod and across the rod to affect the cutting action. Because discernible charring along the cut edge, particularly the edge of the highly combustible wrapper, is undesirable, the patentee describes a process which introduces an inert gas into the tobacco filler so that the gas is present in the formed cigarette rod where the cigarettes are cut off by the laser beam. The gas is caused to move through the wrapped rod with a force sufficient to expel air from the rod. According to the patentee, the inert gas reduces or eliminates charring at the ends of the cigarettes.

While it must be appreciated that the use of a laser for cutting purposes in the manufacture of cigarettes eliminates speed and efficiency constraints imposed by mechanical cutting, the use of an inert gas or other similar means to reduce combustion and/or act as coolant has significant drawbacks. It requires additional equipment in manufacturing facilities where space is limited. Additionally, directing the flow of an inert gas stream through the rod aggravates the problem of loose ends, since the gas flow adversely affects the integrity of the mass of tobacco shreds. The flow of gas may tend to loosen shreds from the mass, resulting in further waste and in coal fall out. Furthermore, the expense of providing the inert gas renders such a process economically unattractive.

Accordingly, it is an object of the present invention to provide a method by which combustible tobacco materials in rod form can be cut with a laser beam under essentially atmospheric conditions without requiring a coolant means to prevent scorching of the shreds and wrapper.

It is still another object of this invention to provide a method by which shredded combustible tobacco materials in rod form can be cut with a laser beam under the aforementioned condtions and produce cut rods with increased end stability.

Other objects and advantages will be readily evident to those skilled in the art in the light of the following description and appended drawings.

SUMMARY OF THE INVENTION

The accomplish the foregoing objects, a rod is cut with a laser beam of specified power level range and within certain time constraints, thereby obtaining a smooth cut without concurrent charring of the paper wrapper. More specifically, a method according to the present invention comprises forming the rod with shreds of tobacco product, moving the rod at a predetermined speed, and transversely cutting the rod under "atmospheric" conditions, i.e., conditions as normally would be found in a manufacturing environment, at predetermined intervals with a laser beam of a power level of not less than about 1,000 watts with a cutting time interval not more than about 15 milliseconds. Inspection of the ends of rods cut in accordance with such a method show no visually discernible charring of the paper.

To increase the end stability of the rods, applicants have found that tobacco material can be initially treated with a non-toxic material which, under the identical constraints imposed above, bonds the shreds together in the narrow region bordering the cut due to the "caramelization" of the non-toxic material. This result is very desirable, since it significantly strengthens the end integrity and thus reduces the amount of shreds which fall out of the rods during further processing and packaging. Increasing the end integrity further reduces the number of shreds which may loosen and accumulate in cigarette packages.

The term caramelize or its cognates, such as caramelization, may be defined for purposes of this description as the melting and rehardening of the added non-toxic material or changing of the added material to a solid material, such that the material in the very narrow region adjacent to the cut surface adheres the shreds together. The caramelization has been observed to occur only when the power level and time constraints set forth above are observed. Consequently, it is surmised that due to the extremely localized thermalization, the shreds and non-toxic material at the cut surface do not char, but are heated just sufficiently to permit the added material to caramelize and, consequently, bond the shreds together.

It should further be understood that "tobacco product" or "tobacco material" includes any smoking materials which, under the conditions described herein, are affected in a similar manner. Consequently, "tobacco product or material" includes, but is not necessarily limited to, natural tobacco and those other materials known collectively as tobacco substitutes.

DESCRIPTION OF THE PREFERRED EMBODIMENTS

Figure 1:
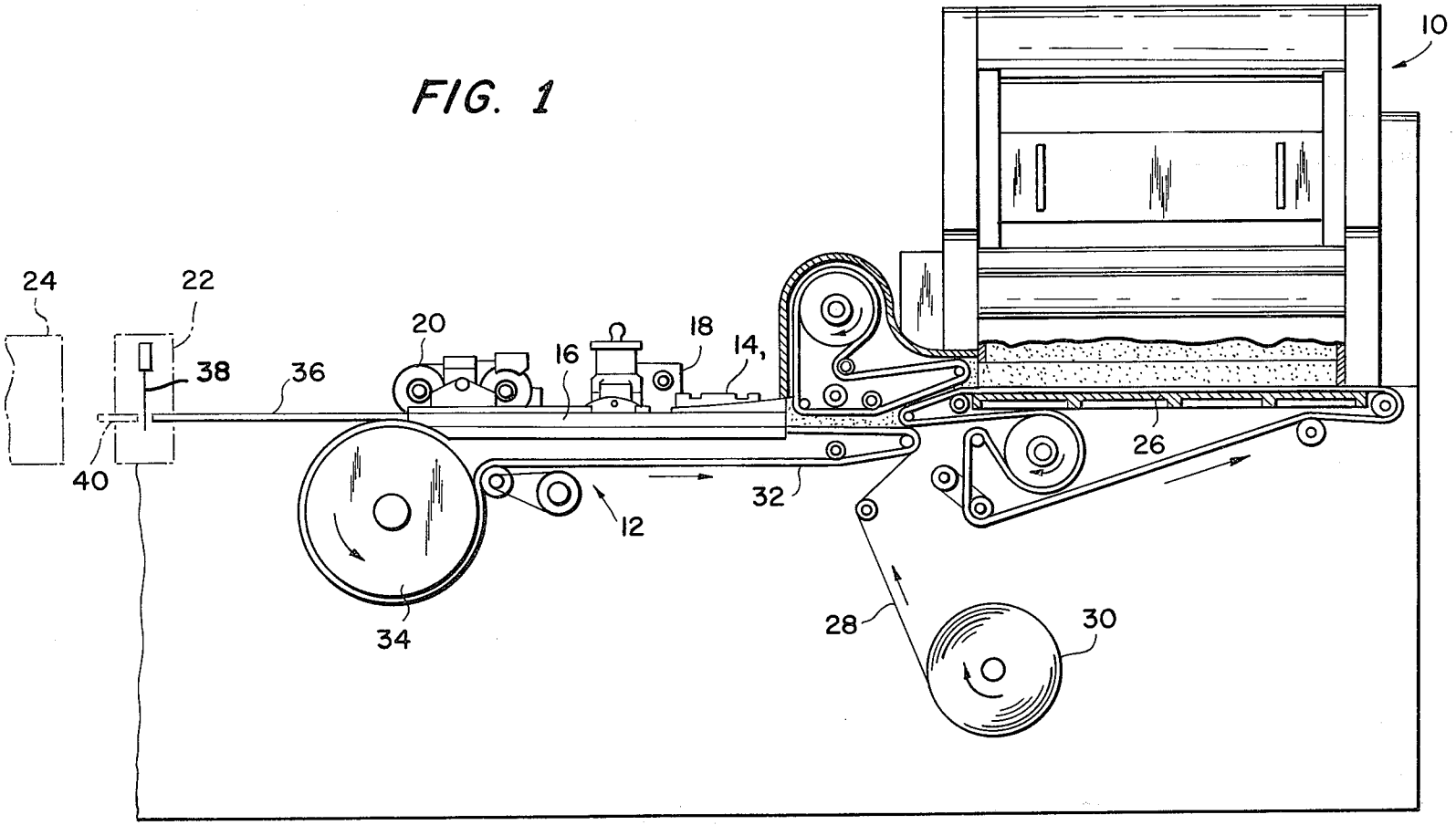
FIG. 1 is a schematic of an apparatus which may be employed in making rod shaped tobacco products in accordance with the present invention.

The schematic of FIG. 1 is used to illustrate an apparatus for making rod-shaped tobacco products, such as cigarettes. The apparatus includes a tobacco feed generally indicated by the numeral 10 and a cigarette maker designated by the numeral 12. The major components of maker 12 are comprised of rod folder tongue 14, rod former 16, a cigarette rod paster 18, and rod sealer 20, a cut-off device 22, and a cigarette catcher or collector 24 (illustrated schematically with phantom lines). In this connection, it should be understood any one of the standard continuous rod cigarette forming machines can be employed in practicing this invention, as for example, the Molins Mark VI or Mark IX manufactured by Molins Machine Company Limited of England, the Haunie Garant-IV manufactured in Hamburg, West Germany, and comparable machinery manufactured by the American Machine & Foundry Company of New Jersey, and of which may have annexed thereto a filter tip attachment common to the industry as is the case with the American Machine & Foundry Filter Tip Attachment.

The tobacco feed 10 showers cut tobacco continuously onto a traveling tape 26, which delivers the showered tobacco to the traveling paper web 28. The paper web 28 is fed from a reel or roll 30 and is suitably guided through the rod folder tongue 14, the rod paster 18 which applies a strip of paste to the lap edge of the cigarette rod paper, the rod former 16 and the rod sealer 20, by a continuously moving folding belt 32 driven by the drum 34. In passing, it is this area of the cigarette maker 12 that is referred to in the industry as the garniture. Drum 34 is continuously driven and takes its drive off the motor (not shown) for the entire cigarette making machine.

When the cigarette rod 36 emerges from the rod former 16, it passes by the laser cut-off device 22, wherein the laser beam 38 is driven in proper timed relation with the movement of the cigarette rod. Thus, individual cigarettes 40 of predetermined length are cut from the rod 36, to be eventually picked up by catcher belts (not shown) and delivered to a suitable collecting receptacle within collector 24.

Figure 2:
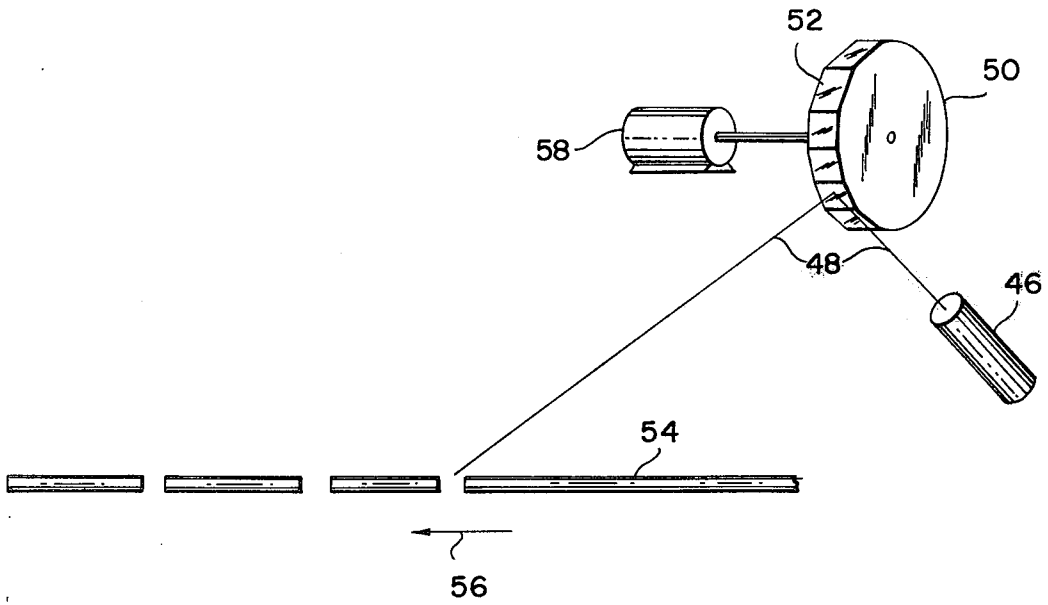
FIG. 2 is a schematic of a laser device which may form part of the apparatus set forth in FIG. 1.

Various laser devices may be utilized to practice the present invention. The apparatus illustrated schematically in FIG. 2 comprises a laser source 46 and a rotating mirror 50 having a plurality of faces 52. The beam 48 of laser source 46 is directed toward mirror 50, such that it sweeps across and cuts rod 54 into segments of equal length. As seen in FIG. 2, the direction of sweep of the laser beam is generally across rod 54. In order to obtain a cut which is transverse to the longitudinal axis, it is further necessary to orient beam 48 at an appropriate angle to the longitudinal axis of rod 54. The angular relationship compensates for high speed movement of rod 54 in the direction indicated by arrow 56. The length of the cut segments can be controlled by varying a number of parameters, but generally is best effectuated by varying the speed of motor 58 driving mirror 50.

Although FIG. 2 depicts a rotating mirror, other reciprocating or rotating reflective devices, such as galvanometerically actuated mirror, may also be employed. Still other devices may be used, such as a beam splitter, allowing the formation of multiple number of laser beams for cutting a rod into a plurality of segments simultaneously.

Figure 3:
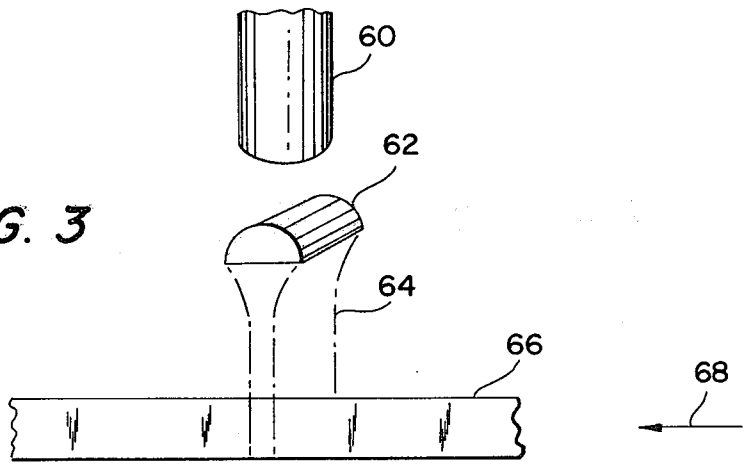
FIG. 3 is a schematic of another laser device which may form part of the apparatus of FIG. 1.

The laser cutting device illustrated in FIG. 3, however, does not require mechanical or electro-mechanical rotating/reciprocating means, since laser 60 is a pulsed laser. It is recognized that extremely high power may be generated by a laser if the pulse time is short. The time interval between pulses may also be controlled. As illustrated in FIG. 3, pulsed laser source 60 generates a pulse of short duration which is focused by cylindrical lens 62 into a lined shaped image 64 (illustrated in phantom) onto a continuous cigarette rod 66 moving in the direction indicated. The pulse cuts the rod into a plurality of rods, the cut being transverse to rod movement. The pulse interval, for example, may be controlled by the making machine which provides a pulse to trigger the pulse laser 60.

Regardless of the laser employed, whether continuous or pulsed, or the mechanism employed to reciprocate the laser beam across the moving rod, the present invention contemplates the use of a laser in such a manner as to preclude the need for coolant and/or inert gases of the prior art devices and methods, yet prevent visually discernible charring or combustion of the materials forming the rod, particularly the paper wrapper. By operating a laser device under specific constraints, such a result has been attained. The specific constraints are as follows:

1. the laser beam should have a power of not less than 1,000 watts;

2. the time interval in cutting the rod should not exceed about 15 milliseconds.

Using a laser device with the requisite time and power level parameters permits the cutting of rod under normal factory conditions, i.e., in an atmosphere of essentially static air, without charring. In addition, the static atmospheric conditions under which the present invention is practiced does not aggravate the problem of loose ends. As stated hereinbefore, movement of coolants or inert gases into the vicinity where the laser cut is occurring can cause a further loosening of the shreds.

Figure 4:
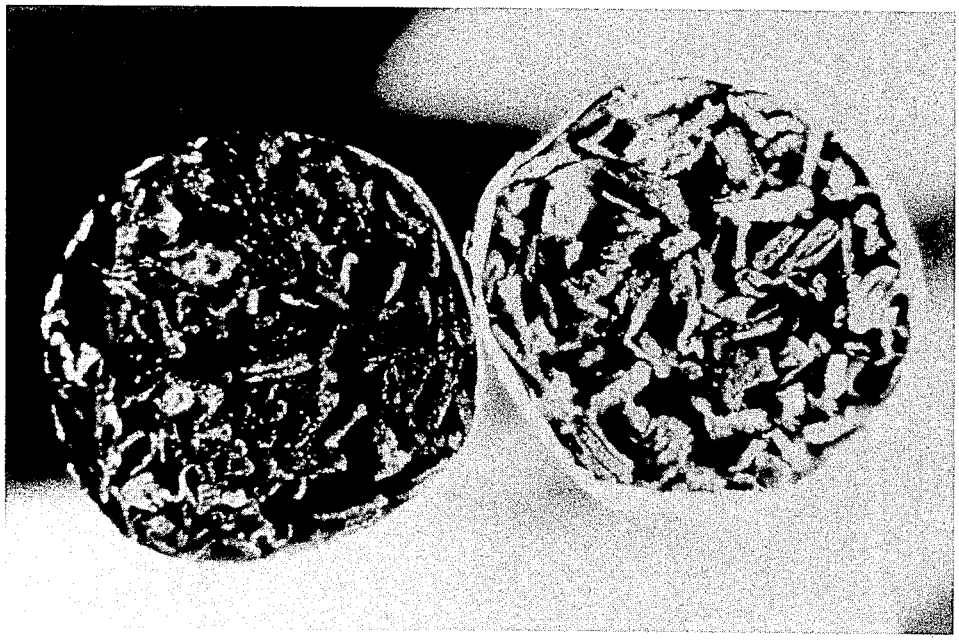
FIG. 4 is an enlarged photograph comparing the end of a tobacco product rod cut conventionally to one cut in accordance with the present invention.

It is preferred, however, to pretreat the tobacco material shreds with a non-toxic material which caramelize in close proximity to the laser beam. To better illustrate the bonding effect due to the caramelization of the added materials reference is made to the photograph of FIG. 4, which compares an end of a cigarette cut by a laser to one cut by a conventional rotating knife edge. The cigarette was cut in accordance with the constraints noted above and under essentially atmospheric conditions. The "roundness" of the laser cut rod on the left is obviously superior to the conventionally cut rod, but no charring of the paper wrap is discernible. The bonding between shreds is readily observable as the darker regions which result from the caramelization of the added material.

The caramelization is a local effect, since examination of shreds obtained from such cut rods outside of the narrow region did not show any observable bonds. It has also been noted that no visually observable bonding occurs when rods are cut observing the laser power level and time parameters when a cooling or inert gas is directed at the point of contact of laser beam and rod. The reason for this effect is not completely understood.

Various non-toxic materials may be added to the blend for the caramelization effect. The necessary characteristic is that the material itself either through melting and rehardening, volatilization, or chemical change adhere the shreds together in the narrow region adjacent the laser cut. Generally, the limitations to the amounts of material which can be added are restraints imposed by the handling or other processing stages of the tobacco. It is evident also that organoleptic effects on the smoker will influence the amount of the added material. Sugars and sugar containing materials, such as sucrose, fructose, glucose, sorbitol, humectose, cocoa, and licorice, have been found particularly suitable to enhance the bonding of shreds. It has been found that adding sugar material in the amounts of 1 to 25% by weight of the tobacco provide desirable bonding results. Additionally, semi-volatile materials, such as the normal paraffin waxes, are effective. These materials are chemically inert within the temperature of burning tobacco materials, do not produce off odors, or affect the natural taste and are non-toxic. In practice, such materials are preferably in amounts from about 0.75 to 4.0% by weight of the tobacco material.

The following examples are provided to better illustrate the present invention, but are not comprehensive and should be considered limiting only within the spirit of the appended claims.

EXAMPLES 1–11

In each of the examples, a multiplicity of rods having a circumference of approximately 25 mm. were made on a conventional making machine and then cut at a specified laser beam power level, each cut being accomplished within a specified time interval. All of the cut rod sections were then visually observed to determine if any charring had occurred to the wrapper. The table below presents the results:

| Example | Power, Watts | Time, Milliseconds | Observation |
|---|---|---|---|
| 1 | 250 | 30 | Very charred. |
| 2 | 250 | 15 | Incomplete cut. |
| 3 | 750 | 20 | Charred. |
| 4 | 750 | 15 | Incomplete cut. |
| 5 | 900 | 20 | Charred. |
| 6 | 900 | 15 | Incomplete cut. |
| 7 | 1,000 | 20 | Charred, complete cut. |
| 8 | 1,000 | 15 | No charring, complete cut. |
| 9 | 1,500 | 20 | Charred, complete cut. |
| 10 | 1,500 | 15 | No charring, complete cut. |
| 11 | 1,500 | 10 | No charring, complete cut. |

EXAMPLE 12

A number of cigarettes were cut from a continuous rod composed of tobacco shreds without any added material of the caramelizing type. The laser cuts were made under static atmospheric conditions with a continuous $CO_2$ laser emitting a laser beam having a power level of 1,000 watts. The cut contact time with the rod was 15 milliseconds. It was visually determined that while the wrapping had not charred, no bonding between shreds had occurred along the cut surface.

EXAMPLE 13

A number of cigarettes were made from the same blend of tobaccos as in those in Example 12, except that about 10% (by weight of the tobacco) of sorbitol was added to the blend. The cigarettes were cut under identical conditions set forth in Example 12. No observable charring had occurred to the paper. Readily observable bonding had occurred between shreds along the cut surface. A substantial reduction in shred fallout was observed upon handling the cigarettes.

EXAMPLE 14

A number of cigarettes were made and cut in a manner identical to that done in Example 13, except that an argon purge was applied at the point of contact of the laser beam with the rod. While no charring was observed, it was also noted that no bonding had occurred between the shreds along the cut surface of any of the cigarettes, resulting in no charge in end integrity.

It is claimed:

1. An improved method of cutting a continuous rod of tobacco product for the manufacture of cigarettes with a laser beam without requiring the presence of an inert gas at the point of cutting into predetermined lengths comprising the steps of a. forming a continuous rod having tobacco product shreds therein;

b. continuously moving the rod at a predetermined speed; and c. cutting the rod at predetermined intervals with a laser beam under essentially atmospheric conditions in a direction such that the cut is substantially transverse to the longitudinal axis of the rod, the laser beam having a power of at least 1,000 watts and being in contact with the rod for a time period not greater than 15 milliseconds thereby causing only local thermalization of the product in the region adjacent to the path followed by the laser beam.

2. The method of claim 1 wherein the laser beam is of the continuous wave type and is deflected through the rod.

3. The method of claim 1 wherein the laser is of the pulsed type and is focused as a line across the rod.

4. The method of claim 1 including the initial step of adding non-toxic materials with the shreds of tobacco product, said organic material being characterized by caramelizing in the presence of the laser beam into a substance which adheres the shreds together in the region adjacent the cut.

5. The method of claim 4 wherein the organic material is selected from the group consisting of sugar, licorice, and cocoa.

6. The method of claim 5 where the added organic material is sugar in the amount of 1 to 25% by weight of the tobacco product.

7. The method of claim 4 in which the added material comprises a paraffin wax.

8. A method for providing tobacco rods for the manufacture of cigarettes with increased end stability using a laser beam without requiring the presence of an inert gas at the point of cutting comprising the steps of a. forming a continuous rod from tobacco shreds treated with a material having the characteristic of forming a non-toxic substance capable of binding the shreds together when in the proximity of a heat source, and b. cuttng the continuous rod at predtermined intervals with a laser beam having a power not less than about 1,000 watts with a cutting contact time of 15 milliseconds wherein the shreds along the narrow region bordering the cut end are bonded together due to the passage of the laser beam.

9. The method of claim 8 wherein the material is selected from a group consisting of sugar, cocoa, and licorice.

10. The method of claim 9 wherein the material is a paraffin.

* * * * *